US007327318B2

(12) United States Patent
Frank et al.

(10) Patent No.: US 7,327,318 B2
(45) Date of Patent: Feb. 5, 2008

(54) ULTRA WIDE BAND FLAT ANTENNA

(75) Inventors: Zvi Henry Frank, Elkana (IL); Ran Timar, Kfar Saba (IL)

(73) Assignees: MTI Wireless Edge, Ltd., Rosh Ha'Ayin (IL); Camero-Tech Ltd., Netanya (IL)

( * ) Notice: Subject to any disclaimer, the term of this patent is extended or adjusted under 35 U.S.C. 154(b) by 0 days.

(21) Appl. No.: 11/363,133

(22) Filed: Feb. 28, 2006

(65) Prior Publication Data

US 2007/0200762 A1 Aug. 30, 2007

(51) Int. Cl.
*H01Q 1/38* (2006.01)

(52) U.S. Cl. ..... 343/700 MS; 343/745

(58) Field of Classification Search ..... 343/700 MS, 343/745, 795, 821
See application file for complete search history.

(56) References Cited

U.S. PATENT DOCUMENTS

| | | | | |
|---|---|---|---|---|
| 4,843,403 | A | 6/1989 | Lalezari et al. | |
| 5,563,616 | A * | 10/1996 | Dempsey et al. | 343/753 |
| 6,061,025 | A * | 5/2000 | Jackson et al. | 343/700 MS |
| 6,437,756 | B1 | 8/2002 | Schantz | |
| 6,501,427 | B1 * | 12/2002 | Lilly et al. | 343/700 MS |
| 6,845,253 | B1 | 1/2005 | Schantz | |
| 7,084,816 | B2 * | 8/2006 | Watanabe | 343/700 MS |
| 7,176,843 | B2 * | 2/2007 | Simasaki et al. | 343/795 |
| 2005/0088344 | A1 * | 4/2005 | Saitou et al. | 343/700 MS |

FOREIGN PATENT DOCUMENTS

WO WO 03/067707 8/2003

OTHER PUBLICATIONS

T.E. Morgan, "Reduced Size Spiral Antenna", Advanced Electronic Warfare Technology, Edited by John Clarke, Royal Signals & Radar Establishment, Great Malvern, UK, pp. 236-240, date is not available.

Schantz, "Introduction to Ultra-Wideband Antennas", The Proceedings of the 2003 IEEE UWBST Conference.

Schantz, "A Brief History of UWB Antennas", The Proceedings of the 2003 IEEE UWBST Conference.

Schantz, "Bottom Fed Planar Elliptical UWB Antennas", The Proceedings of the 2003 IEEE UWBST Conference.

Schantz, "Planar Elliptical Element Ultra-Wideband Dipole Antennas", The Proceedings of the 2002 IEEE APS/URSI Conference.

Powell et al. Differential and Single Ended Elliptical Antennas for 3.1-10.6 GHz Ultra Wideband Communication, IEEE 2004.

Federal Communications Commission, First Report and Order, pp. 1-118, Feb. 2002.

Federal Communications Commission - News, "FCC Affirms Rules to Authorize the Deployment of Ultra-Wideband Technology", pp. 1-4, Feb. 2003.

* cited by examiner

*Primary Examiner*—Tan Ho
(74) *Attorney, Agent, or Firm*—Pearl Cohen Zedek Latzer, LLP

(57) ABSTRACT

A flat, ultra wideband, unidirectional antenna is disclosed, the antenna may comprise a pair of active elements having the shape of substantially half-circles or half-ellipsoids made of thin conductive material and a ground element made of thin conductive material placed parallel and against to the active electrodes and spaced from them, the antenna having a nominal gain of at least 6 dbi and variations of gain in that range of +/−1.5 dbi at its bore sight.

19 Claims, 8 Drawing Sheets

ULTRA WIDE BAND FLAT ANTENNA

BACKGROUND OF THE INVENTION

Several ultra wide band (UWB) antennas are known in the art, such as flat spiral, conical spiral, log periodic, Vivaldi-type, "horn"-type and dipole 'bow tie' antennas. These types of UWB flat antennas suffer from various drawbacks such as having an omni-directional radiation patterns, a low gain, or having a low-quality time response or combinations of the above. There is an ongoing demand for small dimensioned, relatively flat antenna with UWB response curve, a directional radiation pattern, a high gain and good time response over a wide angle of coverage.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1A:
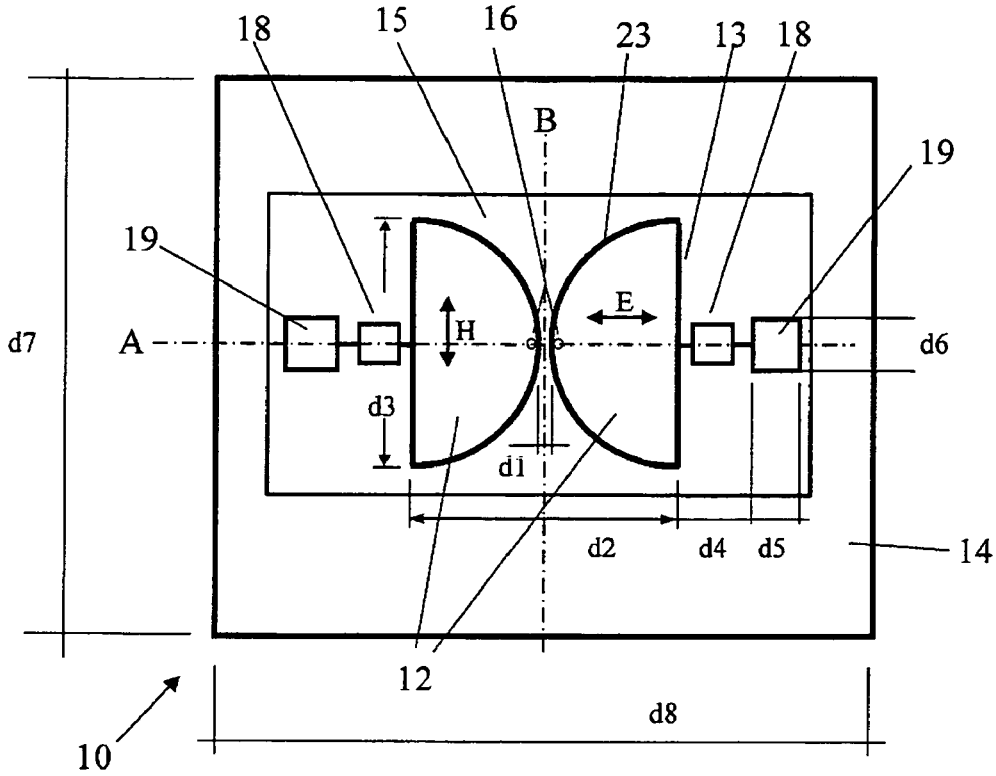
FIGS. 1A and 1B are schematic top and side views respectively of an antenna made according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed, description, numerous specific details are set forth in order to provide a thorough understanding of the invention. However it will be understood by those of ordinary skill in the art that the present invention may be practiced without these specific details. In other instances, well-known methods, procedures, components and circuits have not been described in detail so as not to obscure the present invention.

It should be understood that the present invention may be used in a variety of applications. Although the present invention is not limited in this respect, the antenna design disclosed herein may be used in many apparatuses in vide band or pulse type applications, such as wide band radar for ground penetration or looking through walls and the like.

Figure 1B:
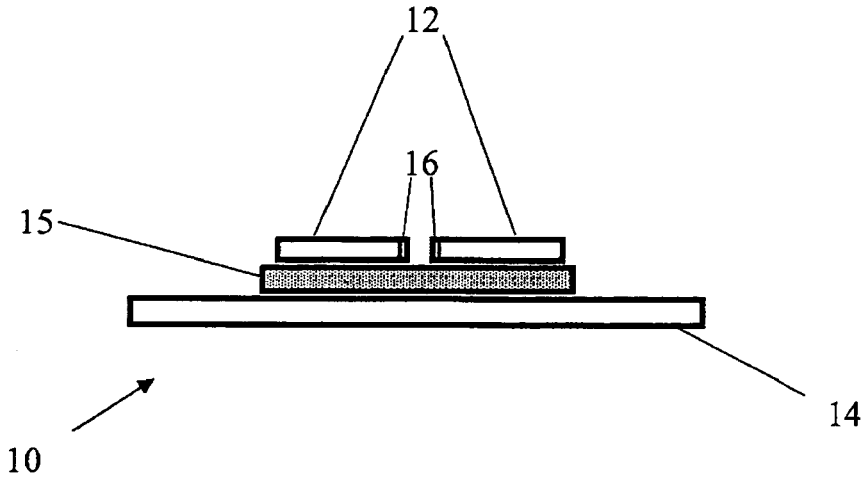

Reference is made now to FIGS. 1A and 1B, which are schematic top and side views, respectively, of antenna 10 according to some embodiments of the present invention. Antenna 10 may be comprised of two co-planar flat elements

12 made of conductive material, a ground conductive plane 14, an insulating layer 15, feeding ports 16, two resistors 18 and two auxiliary conductive planar elements 19. For the sake of clarity the description of antenna 10 will be aided by the use of two symmetry lines A and B as in FIG. 1A. Elements 12 may each have a planar shape having a perimeter including a straight edge 13 and a remainder, which is typically shaped, as shown in shaped edge 23 so that the shaped edges of each of flat elements 12 are facing each other and arranged symmetrically with respect to symmetry line B. Planar elements 12 are further arranged so that their symmetry line coincides with symmetry line A. The straight edges 13 of the two elements 12 may be parallel to each other and the shaped edges 23 may be facing each other.

Shaped edges 23 may have at least one vertex, which may be for example, one or more points or a line, where the distance between the elements is at a minimum. Shaped edge 23 may have any shape, including a curve or a polygon or a combination of the two. Typically, the shape may be such that the length of cross-sections of each element transverse to the line of symmetry A decrease as the distance from the straight edge increases, until the vertex or vertices are reached. In some embodiments, the shape of shaped edge may be such that its cross-section tapers continuously, for example, in accordance with an equation or formula. Shaped edge 23 may be or include, for example but is not limited to, an arc, semi-circle, or other circular section, a semi-ellipsoid or other ellipsoid section, a polygon, or the like. For purposes of obtaining wide bandwidth, good VSWR, and fairly constant gain and beam width over a very wide band shaped edge 23 may preferably have the shape of a smoothly or continuously curved line such as a perimeter of a semi-circle or a semi-ellipsoid. In some embodiments, the contour of the shaped edge may include a notch, by which the contour of the notch section of the shaped edge is curved concave inwards towards the straight edge, for example, in order to filter out a sub-band frequency.

The points on the curved edges 23 most distal from the straight edges 13, i.e., the vertices, may be proximal to each other with a small gap there between. Feeding port 16 may be placed symmetrically close to said small gap at or near the respective vertices of active elements 12, to allow feeding of RF energy to active elements 12. Ground conductive plane 14 may be mounted substantially parallel to the plane containing two active elements 12, in a different plane, with a small gap between the planes.

In some embodiments of the invention, the typical size of the gap between the planes may be approximately 1/10 (one tenth) of the wavelength at low frequency end, yet this size may vary according to various engineering considerations, such as bandwidth or beamwidth requirements. Elements 12 may be co-planar, i.e., on the same flat plane, for example, both may be printed on the same single substrate board. An insulating layer 15 may be placed between the plane of the two active elements 12 and ground plane 14. Insulation layer 15 may be realized using any kind of insulation material and preferably air, which may give better efficiency and bandwidth. Elements 12, 18 and 19 may be supported by or installed on a substrate layer (not shown), which may be made of materials such as teflonglass, epoxyglass, polyesterene, polypropylene and materials for printed circuit board (PCB), etc.

The size and position of ground conductive plane 14 with respect to active elements 12 may vary according to engineering considerations. In the example depicted in FIGS. 1A-1B ground conductive plane 14 may be larger than that of a rectangle inscribing active elements 12 and it may be placed with its center point substantially opposite to the center point between two feeding ports 16 and to the cross of symmetry lines A and B. In another embodiment active elements 12 and ground plane 14 may be printed on two separate insulating boards spaced from each other with any kind of method to space between them.

The two main axes of antenna 10 are commonly marked H for the vertical axis and E for the horizontal axis, as marked by the respective double-headed arrows in FIG. 1A. Main axis E coincides with symmetry line A and main axis H coincides with symmetry line B. Antenna 10 has a boresight axis which is substantially perpendicular to the plane of the page of FIG. 1A and crosses substantially in the cross point of symmetry axes A and B. Reference planes H and E are defined so that they comprise the antenna boresight and either main axis H or E respectively.

Auxiliary conductive planar elements 19 may have substantially rectangular, circular, elliptical or other shapes, which substantially may be enclosed in a rectangle as depicted in FIG. 1A. Auxiliary elements 19 may be positioned symmetrically with respect to symmetry line B along symmetry line, spaced on the side of primary elements 12 proximal to the straight edge and at distance d4 from the straight edge 13 of the respective active element 12. Auxiliary elements 19 may be called also auxiliary active elements 19. Impedance elements such as resistors 18 may be electrically connected at one end to one of active elements 12 substantially at a point most distal from its vertex, on its bisector. Resistors 18 may further be connected at its other end to auxiliary active element 19. Two auxiliary active elements 19 may be placed in the plane of active elements 14 with one of their symmetrical axis coinciding with axis E of antenna 20. This arrangement may provide forward flow path for RF energy fed to two active elements 12 and by this substantially minimize and even eliminate back-flow of such energy, thus enhancing the dispersion of the impulse response signal (by eliminating the trailing rings) of antenna 10. Active elements 12 and auxiliary active elements 19 may be realized on a common PCB layer. It will be noted that impedance element may be a resistor, a capacitor or an inductor, or any suitable combination thereof.

The various parts of antenna 10 may have dimensions d1-d8 (FIG. 1) as may be dictated by the performance required from it. Typical dimensions of the various parts of antenna 10, which may allow the performances depicted in drawings FIGS. 3A to 5B may be, as a non-limiting example, in fractions or multiples of the wavelength λ of the low-end of the working frequency band width of antenna 10: d1=0.008, d2=0.27, d3=0.36, d4=0.02, d5=0.08, d6=0.07, d7=0.93 and d8=0.93. It would be apparent to a person with ordinary skill in the art that these typical dimensions may be varied so as to satisfy various engineering requirements without departing from the concept of the invention.

Feeding ports 16 may feed two active elements 12 allowing a balanced feed. Feeding lines (not shown) may be realized by two parallel printed lines on the opposite sides of a PCB being the substrate layer. According to yet another embodiment of the present invention feeding ports 16 may be fed from an unbalanced feeding line (such a coax cable) using any kind of balanced-to-unbalanced ("balun") adaptor device.

Baluns of the known art may be used in connection with the antenna of the present invention; however, such known baluns may typically quite large and bulky with respect to typical dimensions of a flat antenna. For purposes of providing an antenna with a very low profile, a flat UWB balun is presented that may be used in connection with the antenna of the present invention. Attention is made now to FIGS. 2A-2C, which are a schematic top view with blow-up view, a positional view and partial side cross-section view respectively of a flat balun 60 according to some embodiments of the present invention. Flat balun 60 according to an embodiment of the present invention may be realized by removing part of conductive ground plane 14, substantially shaped as an "H", having two side legs and a middle leg, and centered at the crosspoint of symmetry lines A and B and placed with respect to active elements 12 as shown in FIG. 2B. Flat balun 60 may be achieved, for example, by removing a rectangle 62 having width e1 and height h1+h2+ h3 centered at the cross point of symmetry lines A and B, but leaving two non-removed strips 63 and 64 protruding from two opposite sides of perimeter of rectangular 62 into its center along symmetry line A, symmetrically with respect to both symmetry lines A and B, leaving a space e2 between them.

Flat balun 60 may have balanced and unbalanced ports. The unbalanced port may be located at 61 and be between microstrip line 66, which is a conducting strip on the underside of the ground plane substrate and ground plane 14. Microstrip 66 may begin at a side of ground substrate proximal to strip 63 and on a side opposite the conducting side, extend underneath strip 63, across the gap separating strips 63 and 64 and have its terminus at port 68. The balanced port may be at edges 67 and 68. The connection between the balanced side and unbalanced side may be via feed-through hole 68. Thus, the ground plane may be common to both balanced and unbalanced ports.

Figure 2A:
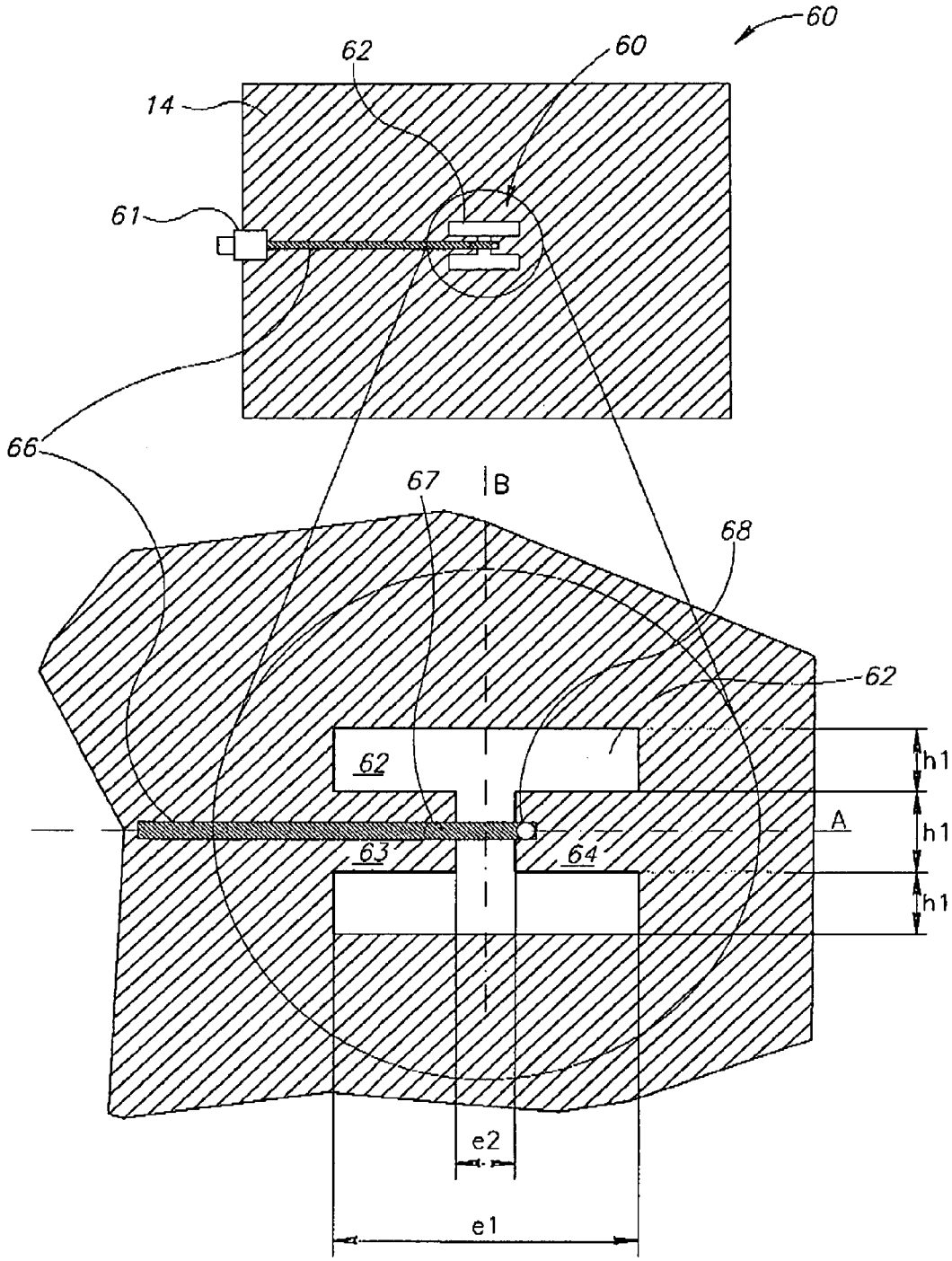
FIGS. 2A-2C are a schematic top view with blow-up view, a positional view and partial side cross-section view respectively of a flat balun according to some embodiments of the present invention.
Figure 2B:
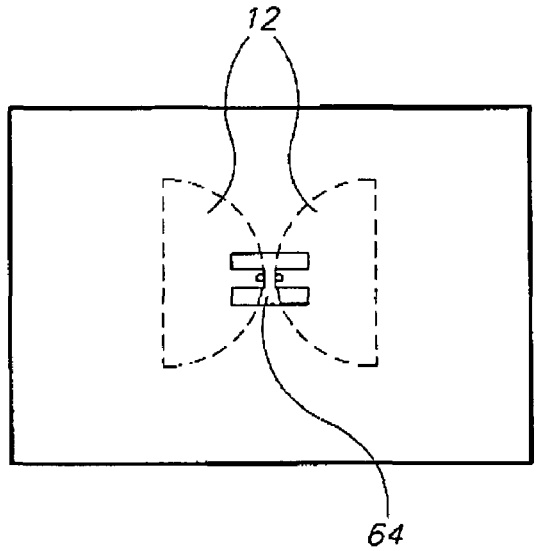
Figure 2C:
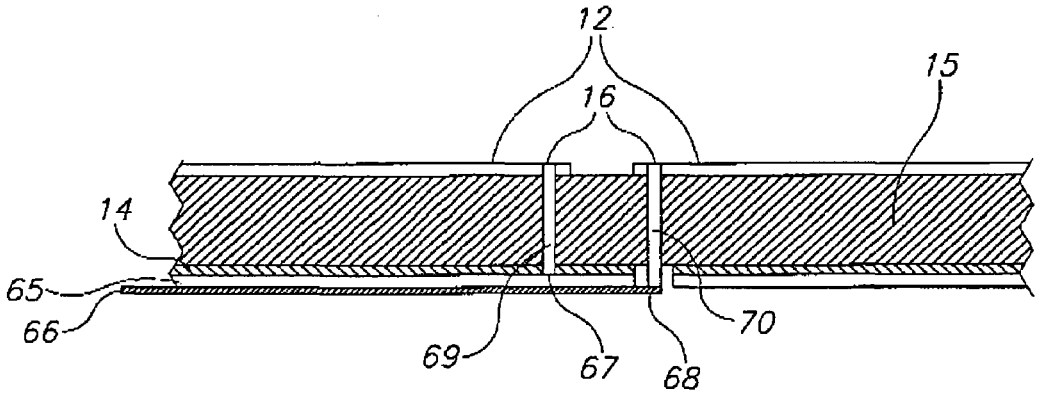

RF energy emitted from the output of flat balun 60 may be conveyed to feeding ports 16 of antenna 10 by means of conductors 69, 70 (shown in FIG. 2C), in a plane perpendicular to the plane shown in FIG. 2A. Conductors 69, 70 may be printed on substrate. Accordingly, unbalanced RF energy may be provided to the system of antenna 10 via connector 61 and strip line 66 and converted to balanced energy to antenna 10.

Installation of flat balun 60 made according to embodiments of the present invention may comprise feeding of RF energy in an unbalanced line 66 to unbalanced port 68 and feeding of RF energy to active elements 12 in balanced conductors 69, 70, where ground element 14 is realized on the top side of PCB 65 and strip line 66 on the lower side of it.

Typical dimensions of balun 60 that may provide for the performances described in this application may be, as a non-limiting example, in fractions of the wavelength λ of the low-end of the working frequency band width of antenna 10: h1=h3=0.05, h2=0.04, e1=0.14 and e2=0.008.

Reference is made now to FIGS. 3A, 3B, 4, 5A and 5B which are diagrams of the electrical performance of antenna 10 according to some embodiments of the present invention.

An antenna made according to the present invention may have a UWB performance profile, a very low physical profile, high gain, low dispersion, high quality of impulse response and time response.

Figure 3A:
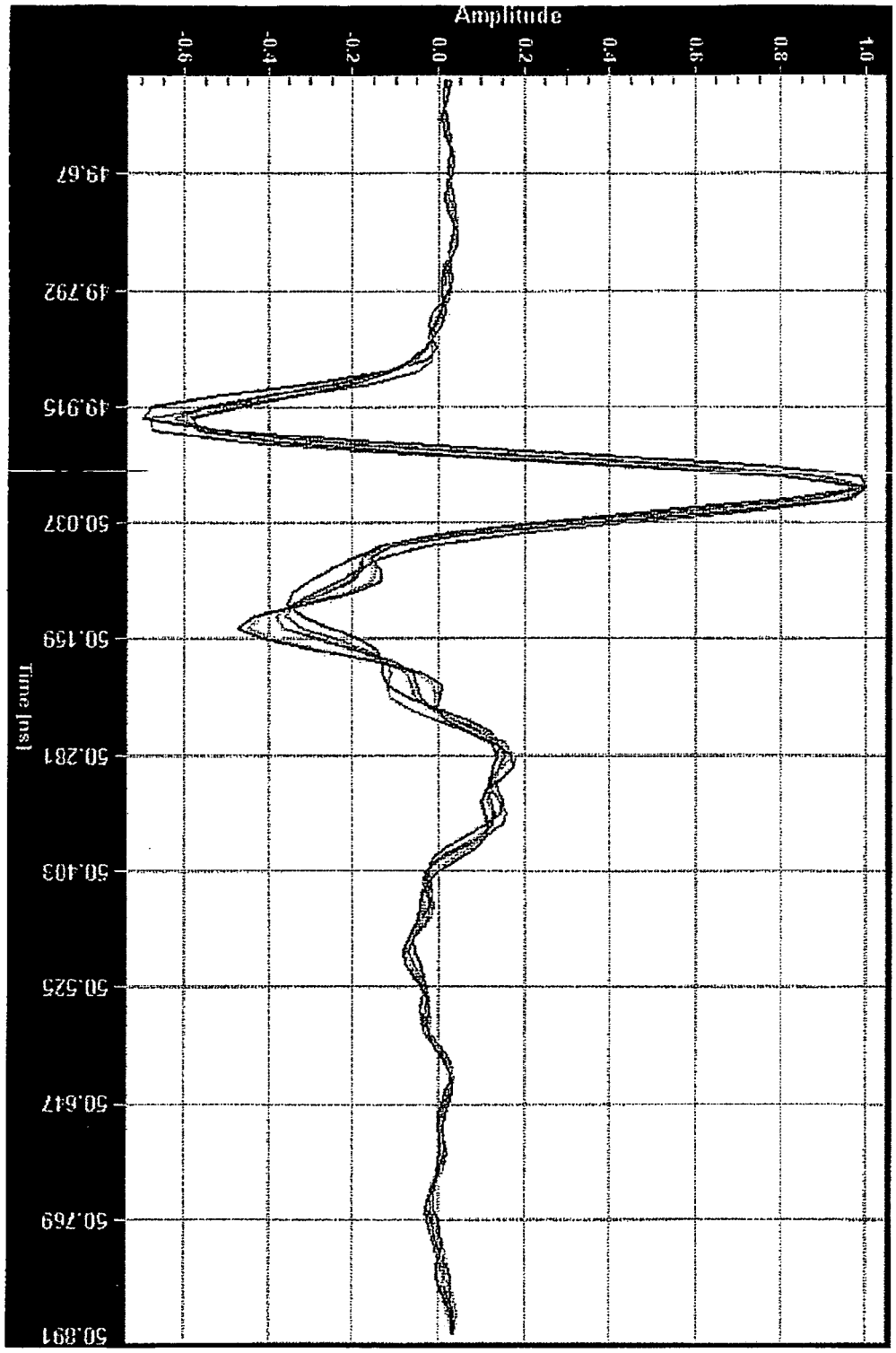
FIGS. 3A and 3B are response diagrams of an antenna according to some embodiments of the present invention.
Figure 3B:
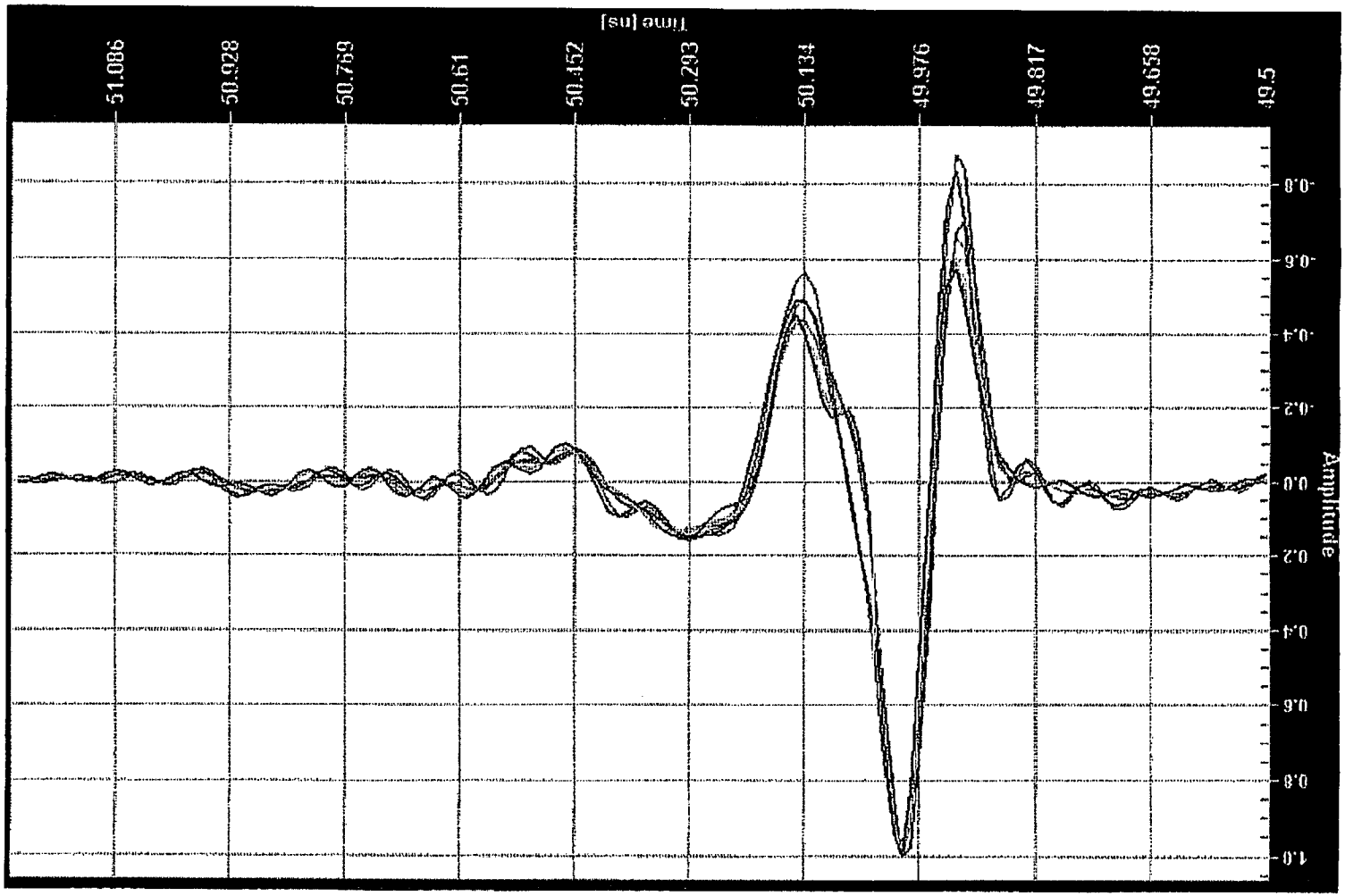

Reference is made now to FIGS. 3A and 3B, which are normalized impulse response diagrams of antenna 10 according to some embodiments of the present invention, given for seven different angles, substantially equally distributed off the bore sight from −30 degrees to +30 degrees, plotted on same graph. FIG. 3A depicts normalized impulse response of antenna 10 for 0, +/−10, +/−20 and +/−30 degrees off bore sight line in the E plane and FIG. 3B depicts normalized impulse response of antenna 10 for 0, +/−10, +/−20 and +/−30 degrees off bore sight line in the H plane.

As may be seen in FIGS. 3A and 3B, impulse response of antenna 10 exemplifies very low dispersion across the various angle of deviation from the bore sight line. The dispersion may be measured as the standard deviation between the graphs at every given point along the horizontal axis (time), averaged over time required for reception of 98% of the pulse energy. This mean deviation at any time taken over all time required for reception of 98% of the pulse energy may be denoted $A_{rel_div_avg}$.

Preferably, in embodiments of the invention having the flat balun described above, $A_{rel_div_avg}$ may be less than $4\times10^{-4}$ for each of the E and H planes. The graphs of FIGS. 3A and 3B show the deviation in time domain for an antenna with the flat balun described herein with a 2 mm thick radome, having values $2.5\times10^{-4}$ and $3.7\times10^{-4}$ respectively for the E and H planes. It will be apparent to person with ordinary skill in the art that these values of $A_{rel_div_avg}$ indicate a very low dispersion in the angle of interest of antenna 10. In another embodiment of the invention using a conventional or mechanical balun, $A_{rel_div_avg}$ may be less than $3\times10^{-4}$ or more preferably less than $2.5\times10^{-4}$. In one embodiment (graph not shown), $A_{rel_div_avg}$ may have values of $1.4\times10^{-4}$ and $2.4\times10^{-4}$ respectively for the E and H planes.

Figure 4:
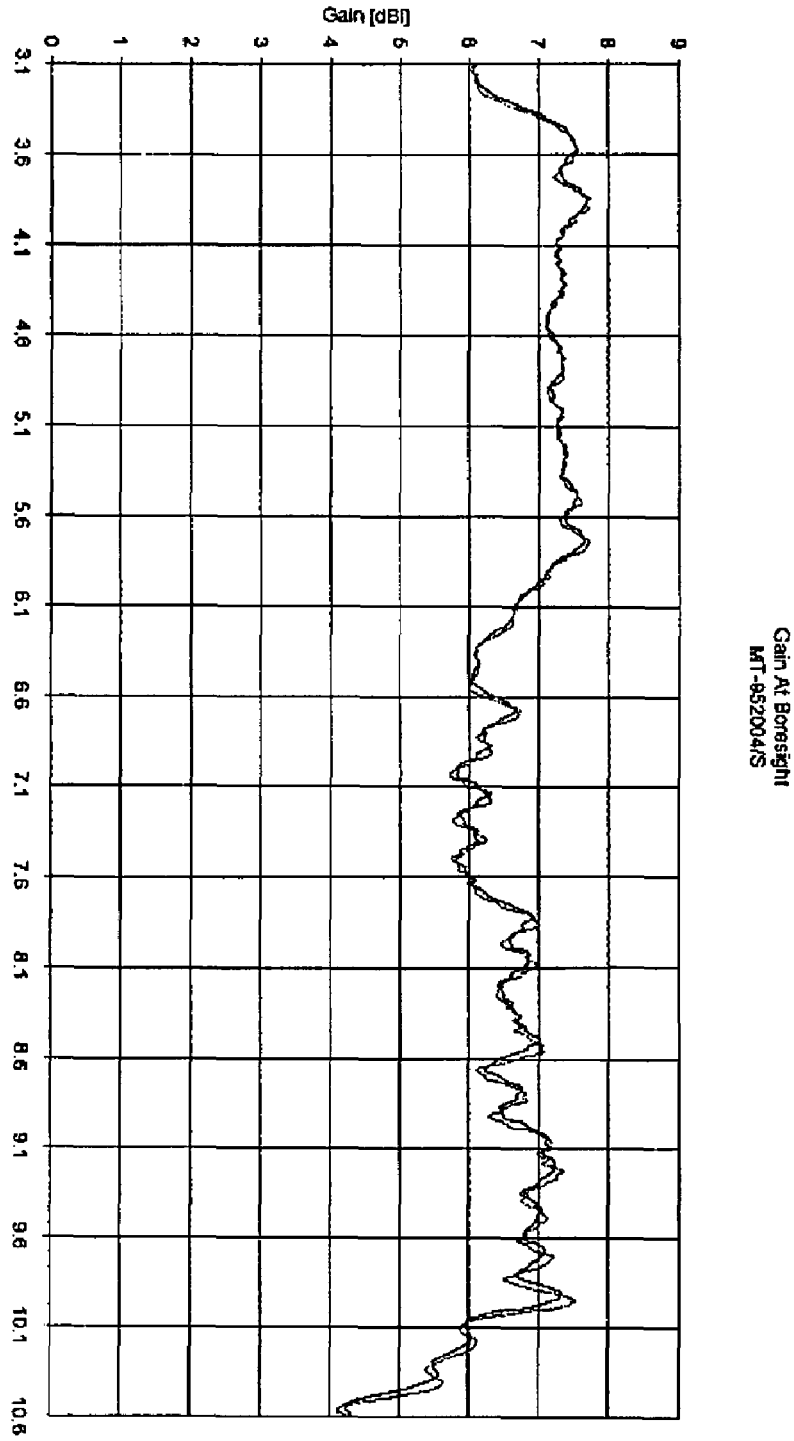
FIG. 4 is a graph depicting electrical gain of antenna according to the present invention.

Attention is made now to FIG. 4, which depicts the electrical gain of antenna 10 in varying frequencies at the boresight of the antenna. FIG. 4 depicts results received in both E and H planes (also known as azimuth and elevation planes respectively). In one embodiment of the present invention, the antenna may have gain variation within limits of +/−1.5 dbi (decibels referenced to isotropic radiator) over a frequency range having a ratio of high end-to-low end higher than 3 and preferably 3.4 or higher, for example, from 3.1 to 10.6 GHz. The absolute nominal gain may generally be better than 6 dbi over the band 3.1 to 10.6 GHz, which is much higher than that of prior art UWB flat antennas. It would be noted that the gain of antenna 10 as depicted in graph of FIG. 4 complies with the definitions of an ultra wide band (UWB) antenna, as defined, for example, by the US Federal Communications Commission (FCC).

Figure 5A:
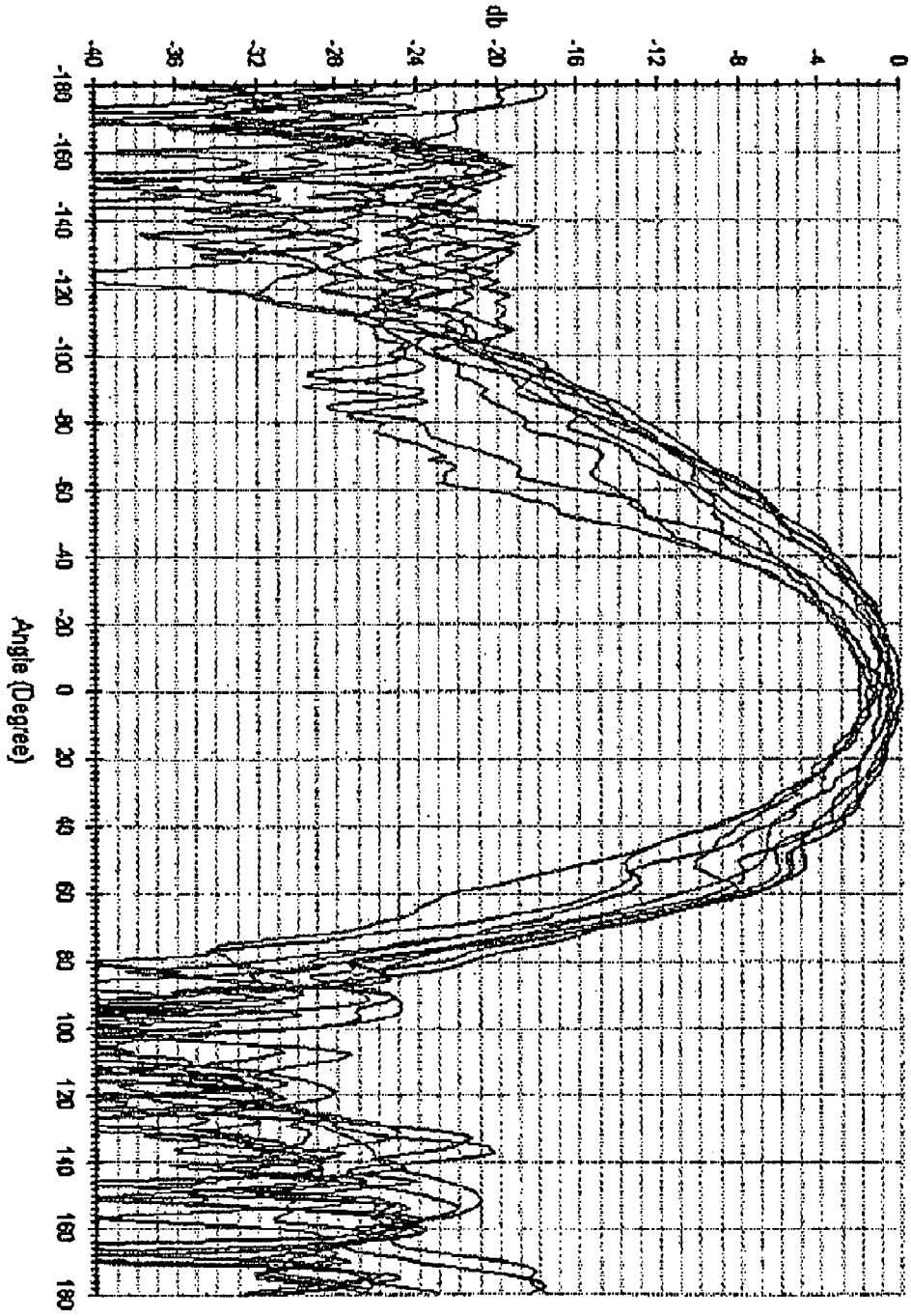
FIGS. 5A and 5B are graphs depicting the radiation curve of an antenna according to some embodiments of the present invention.
Figure 5B:
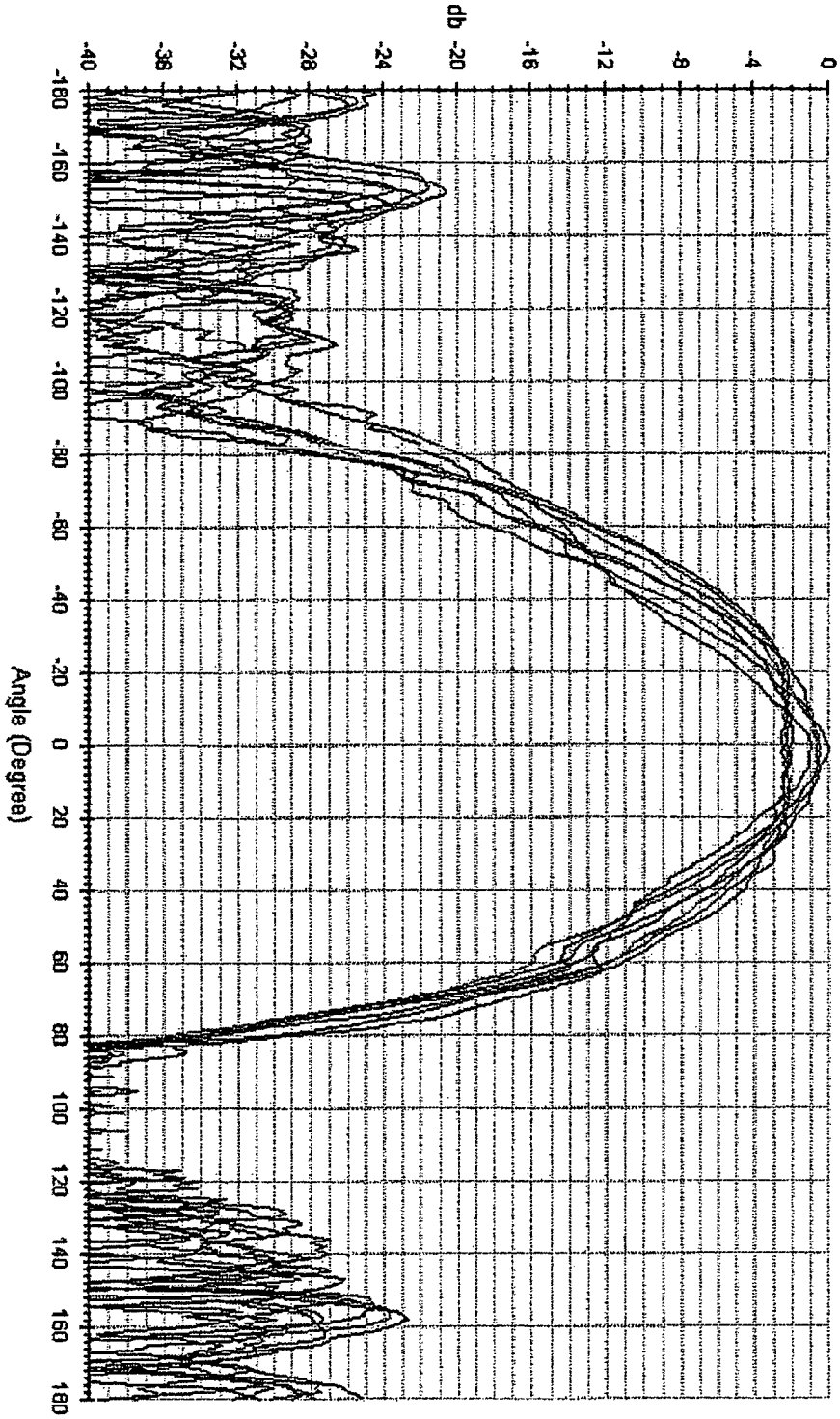

Attention is made now to FIGS. 5A and 5B, which depict normalized radiation curves of antenna 10 according to the spatial inclination angle from the boresight of the antenna FIG. 5A depicts measurements taken in E plane and FIG. 5B depicts measurements taken in H plane, both with respect to boresight axis for 10 different frequencies in the range of 3.1 to 10.6 GHz. FIGS. 5A and 5B exhibit the performance of antenna 10 with respect to beam width versus frequency exemplifying that its beam width is substantially constant over the bandwidth for beam angles in the range of −/+30° from boresight.

It will be appreciated by persons of ordinary skill in the art that according to some embodiments of the present invention other designs of flat antenna with substantially two circle-like conductive planes and a ground planes according to the principles of the present invention are possible and are in the scope of this application.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An antenna comprising:

first and second flat conductive coplanar primary elements, each said element having a perimeter including at least one straight edge and at least one shaped edge, said shaped edge including at least one vertex at which said shaped edge is a maximal distance from said straight edge, wherein said primary elements are symmetrical about a line bisecting said straight edges of said elements, wherein corresponding vertices of said first and second primary elements are the most proximal points of said elements, and wherein each of said first and second primary elements includes at least one radio frequency (RF) feeding port proximal to said vertex, respectively;

first and second flat conductive auxiliary elements coplanar with said primary elements, said auxiliary elements located on a side of said primary elements proximal to said straight edges of said primary elements, wherein said auxiliary elements are symmetrical about said bisecting line;

first and second impedance elements electrically connecting each of said primary elements to a respective auxiliary element; and a flat conductive ground element in a plane substantially parallel to said primary elements, said ground element lying in a different plane than said primary elements, wherein the conductive area of said ground element is larger than the area of a rectangle defined by the straight edges or said primary elements, wherein a center point of said ground element is substantially opposite a point equidistant to said feeding ports of said primary elements.

2. The device of claim 1, wherein said shaped edge is a circular section.

3. The device of claim 1, wherein said shaped edge is an ellipsoid section.

4. The antenna of claim 1, wherein said primary and auxiliary elements are placed on a primary substrate made of a material selected from the list consisting of teflonglass, epoxyglass, polyesterene and polypropylene.

5. The antenna of claim 1, wherein said ground element is printed on a ground substrate made of material selected from the list consisting of teflonglass, epoxyglass, polyesterene and polypropylene.

6. The antenna of claim 1, wherein said ground element is placed on a first face of a ground substrate, and wherein said ground element includes a balanced to unbalanced adaptor, said adaptor comprising:

an "H"-shaped non-conducting area on said first face of said ground substrate and centered at the center point of said ground element, said non-conducting area defining first and second conducting strips of said ground element bounded by side legs and a middle leg of said non-conducting area, wherein the middle leg of said non-conducting area is oriented in a direction perpendicular to said symmetry line;

on a second face of said ground substrate opposite said first face, an unbalanced input conducting strip starting at a side of said second face proximal to said first conducting strip and extending under said first conducting strip and said middle leg of said H-shaped non-conducting area and terminating under said second strip; and a conductor electrically connecting said first and second conducting strips with said feeding ports of said first and second primary elements, respectively.

7. The antenna of claim 6, wherein the difference between values of gain or said antenna at bore sight for any frequency in the range of a low frequency to a high frequency is in the range of +/−1.5 dbi and wherein said low and high frequencies have ratio of at least 3.0 to 1.

8. The antenna of claim 6, wherein the difference between values of gain of said antenna in the range of +/−30 degrees around its boresight for any frequency in the range of a low frequency to a high frequency is not greater than 6 db and wherein said low and high frequencies have ratio of at least 3.0 to 1.

9. The antenna of claim 6, wherein a length of said straight edge of said primary elements is substantially 0.36λ, wherein the distance between two said straight edges is substantially 27λ, and wherein the distance between said vertices of said primary elements is substantially 0.008λ, in which λ is the wavelength of the low end of the working band width of said antenna.

10. The antenna of claim 6, wherein the gap between said primary elements and said ground element is substantially 0.1λ, in which λ is the wavelength of the low end of the working band width of said antenna.

11. The antenna of claim 6, wherein the said auxiliary elements are rectangles having dimensions substantially 0.08λ by 0.07λ, in which λ is the wavelength of the low end of the working band width of said antenna.

12. The antenna of claim 6, wherein nominal gain at boresight line of said antenna varies by not more than +/−1.5 dbi between a low frequency and a high frequency, wherein the ratio between said high frequency and said low frequency is greater than 3.0.

13. The antenna of claim 12, wherein the ratio between said high frequency and said low frequency is greater than 3.4.

14. The antenna of claim 12, wherein said low end is substantially 3.1 GHz.

15. The antenna of claim 12, wherein said high end is substantially 10.6 GHz.

16. The antenna of claim 12, wherein the nominal gain is at least 6 dbi.

17. The antenna of claim 6, having an normalized impulse response wherein the standard deviation between all angles ranging from +/−30 degrees from boresight at any plane perpendicular to the plane of the antenna, averaged over the time interval containing 98% of received pulse energy is not greater than $4.0\times10^{-4}$.

18. The antenna of claim 1, wherein said impedance element includes at least one element from the set consisting of a resistor, a capacitor and an inductor.

19. The antenna of claim 1, having an normalized impulse response wherein the standard deviation between all angles ranging from +/−30 degrees from boresight at any plane perpendicular to the plane of the antenna, averaged over the time interval containing 98% of received pulse energy is not greater than $2.5\times10^{-4}$.

* * * * *